US007168509B2

(12) United States Patent
Cooper

(10) Patent No.: US 7,168,509 B2
(45) Date of Patent: Jan. 30, 2007

(54) PERCUSSIVE REAMER AND METHOD OF USE THEREOF

(76) Inventor: Cary W. Cooper, 15 Deer Run Trail, Winder, GA (US) 30680

( * ) Notice: Subject to any disclaimer, the term of this patent is extended or adjusted under 35 U.S.C. 154(b) by 251 days.

(21) Appl. No.: 10/887,728

(22) Filed: Jul. 9, 2004

(65) Prior Publication Data

US 2006/0006001 A1 Jan. 12, 2006

(51) Int. Cl.
*E21B 10/26* (2006.01)

(52) U.S. Cl. ..... 175/53; 175/295; 175/415

(58) Field of Classification Search ..... None
See application file for complete search history.

(56) References Cited

U.S. PATENT DOCUMENTS 3,750,767 A * 8/1973 Pessier ..... 175/53
3,835,942 A 9/1974 Leonardi
3,924,695 A 12/1975 Kennedy
4,386,668 A 6/1983 Parish
4,878,547 A 11/1989 Lennon
5,027,914 A * 7/1991 Wilson ..... 175/406
5,029,657 A * 7/1991 Mahar et al. ..... 175/393
6,189,630 B1 2/2001 Beck, III
6,439,322 B2 8/2002 Beck, III
6,454,025 B1 * 9/2002 Runquist et al. ..... 175/61
6,467,558 B2 10/2002 Miyamoto et al.
2001/0006120 A1 7/2001 Miyamoto et al.
2001/0022240 A1 9/2001 Beck, III
2003/0116357 A1 6/2003 Peterson et al.

* cited by examiner

*Primary Examiner*—Frank Tsay
(74) *Attorney, Agent, or Firm*—Williamson Intellectual Property Law, LLC; Thomas R. Williamson, III

(57) ABSTRACT

A percussive drill bit or reamer having a plurality of bit segments formed into a circular pattern suitable for drilling or reaming a hole. The bit segments are close-fitted and shaped to increase the cutting area and improve efficiency. Pressurized air exhausted from driving the percussion mechanism, or provided from a separate source, is passed into the bit segment and exits from a side face thereof into the gap formed between adjacent bit segments, thereby driving out any debris present in the gap and preventing binding of the bit segments. When utilized with mechanically-driven percussive bit assemblies, where air is only needed to remove debris from a rock face, separately-provided air is delivered to the bit segments of the present invention as described above to clear the gaps of debris.

15 Claims, 2 Drawing Sheets

PERCUSSIVE REAMER AND METHOD OF USE THEREOF

TECHNICAL FIELD

The present invention relates generally to drilling devices and methods, and more specifically to a percussive drill bit and method of use thereof.

BACKGROUND OF THE INVENTION

When constructing oil or water conduits, drainage courses, communications and/or electrical transmission and distribution lines, it is often necessary to bore or drill holes in rock disposed under roadways and/or building foundations, without disturbing the structural integrity of such foundations.

To drill such holes, it is common to dig a shaft on either side of the foundation or structure, and by means of an auger in soft ground or a rock drill in harder ground, drive the auger or drill from shaft to shaft. This is typically accomplished via conventional drilling techniques that push the auger or rock drill, most often by utilizing a rotary drill string. The auger or drill, and the trailing drill string, are inserted in sections and driven from one of the shafts to the other.

Typically, such boring or drilling is carried out by a drill head having one or more drill bits, or bit segments, with a means for driving the bits/segments, wherein the driving mechanism typically utilizes fluid power or, alternately, is mechanically driven.

The driven drill head is often a rotary bit having cutting surfaces thereon, wherein the cutting surfaces 'grind away' at a selected rock face. In addition to rotary drills, percussive bits are often selected for performing the cutting operation. Such percussive bits operate by impact, and are typically driven by either mechanical force or by the force of pressurized air. Still other bits incorporate combined rotation and percussion in operation thereof.

It is often necessary to enlarge a hole once drilled, or to bore a large hole by successive passes with a reamer after first drilling a pilot hole. For drilling narrow diameter holes, a simple, single drill will often suffice. However, for larger diameter holes it is often necessary to begin by drilling a smaller pilot bore and then increasing the diameter of the bore by successively pulling reamers of increasing diameter through the bore.

Additionally, while drilling, material removed from a rock face must somehow be removed. Unfortunately, a single rotational or percussive drill bit fills the full diameter of the hole drilled and, thus, leaves little room for clearance of material from the dirt or rock face that the drill bit is cutting. Failure to clear the debris from the hole results in packing of the debris, and, thus, leads to clogging and binding of the drill bit. Accordingly, drill bits, or bit segments, are often grouped together to form a cutting surface with space available for removal of the debris that accumulates from the cutting operation. Such a device utilizing a cluster of circular rotational and percussive drill bits is described in the U.S. Pat. No. 4,878,547 to Lennon. Unfortunately, however, the device of Lennon '547 lacks airflow suitable to remove debris from the rock face being cut.

A cluster of air-driven percussive drill bit segments is disclosed in the U.S. Pat. No. 6,467,558 to Miyamoto et al. Since it is still necessary to clear debris from the rock face and prevent accumulation of debris, air is often utilized where the percussive bit is mechanically driven. Miyamoto et al. '558, discloses air transmission tubes formed around the central shaft of the drill bit in order to bring air to the rock face. While the device of Miyamoto et al. '558 utilizes air flow, the air flows out of the tubes surrounding the bit segments, not out of the sides of the bit segments themselves, and thus, does not facilitate clearing of debris from the gaps between the bit segments. Accordingly, Miyamoto et al '558 utilizes scalloped areas to permit debris removal and prevent clogging of the bit segments.

Moreover, due to the space between the bit segments of the Miyamoto et al. '558 device, and the scalloped areas of same, there is a reduced area available for active cutting surface, and as such, a reduction in operational efficiency.

If the gaps between bit segments can be closed together, larger surface area drill bit segments could be utilized, thereby increasing the cutting efficiency of the drill/reamer. However, as such gaps are closed to gain increased cutting surface area and its resultant more efficient spacing, there is a greater likelihood of binding and clogging of the bit segments due to debris finding its way in between the bit segments. Accordingly, some means must be utilized to remove debris from gaps between close-fitting segments.

Therefore, it is readily apparent that there is a need for a percussive reamer/drill bit and method of use thereof for facilitating the removal of debris from the gaps between the sides of bit segments, thereby permitting the bit segments to be placed closely adjacent one another, and thus increasing available cutting surface area and improving overall efficiency.

BRIEF SUMMARY OF THE INVENTION

Briefly described, in a preferred embodiment, the present invention overcomes the above-mentioned disadvantages and meets the recognized need for such a device by providing a percussive drill bit or pull reamer having a plurality of bit segments formed into a circular pattern suitable for drilling or reaming a hole. The bit segments are close-fitted and shaped to increase the cutting area and improve efficiency. Pressurized fluid, such as air, exhausted from driving the percussion mechanism, or provided from a separate source, is passed into the bit segment and exits from a side face thereof into the gap formed between adjacent bit segments. The air thereby drives out any debris present in the gap and prevents binding of the bit segments. By utilizing a slant-face bit, debris is carried by the airflow, past, and aft of, the drill head. When utilized with mechanically-driven percussive bit assemblies, where air is only needed to remove debris from a rock face, separately-provided air is delivered to the bit segments of the present invention as described above to clear the gaps therebetween of debris.

More specifically, the present invention is a percussive reamer or drill bit comprising slant-face bit segments and bit segment holders, wherein the individual bit segments are held within the segment holders. The segment holders surround a central drill drive rod and are carried thereby. The drill drive rod is adapted to fit a drill bit powering mechanism, and has a threaded connector at the front thereof. The bit segments have guides that slidably engage vanes within the segment holders, thus permitting the percussive forward-and-backward motion of the drill bit segment.

Additionally, the bit segments each have a bit head with a slant-face and sides. The slant-face has air holes extending therethrough and carbide buttons thereon to perform the cutting operation. The body of the bit segments have air channels therewithin. Air inlets permit a flow of exhaust air (i.e., delivered via a high-pressure air supply source) through the bit segment. Accordingly, as air exits from the face air hole, debris is blown away from the rock face being worked.

The sides of the bit segments also have air holes extending therethrough, wherein air flows from the air inlets through the channels within the bit segments, and out from the side air holes for clearing debris from the gaps between the sides of the drill bit segments.

In the preferred embodiment, five slant-face bit segments, with gaps therebetween, form a cutting head shaped in the form of a donut ring. In operation, the present invention is pulled or pushed against a rock face, while the bit segments are driven by a percussion drive mechanism, repetitively impacting on the rock face for pulverizing same. Air flowing through the bit segments exhausts into the gap between the segments keeping the gaps and bit segments clear from debris, while air flowing through the face clears debris from the rock face.

Accordingly, a feature and advantage of the present invention is that bit segments can be closely spaced together without binding of same from drilling debris.

Another feature and advantage of the present invention that it permits utilization of any number of bit segments.

Yet another feature and advantage of the present invention is its ability to drill or ream a straight hole with minimal ground disturbance.

Still another feature and advantage of the present invention is its ability to utilize bit segments of varying configurations.

Yet another feature and advantage of the present invention is its ability to utilize existing air sources in drill bit applications.

Yet still another feature and advantage of the present invention is its ability to be selectively utilized as a reamer pulled through a hole, as a reamer pushed through a hole, or as a drill to bore a hole.

A further feature and advantage of the present invention is its ability to utilize any cutting material on the cutting face of the present bit segment.

Still yet another feature and advantage of the present invention is its high efficiency in view of its relatively large cutting area.

These and other features and advantages of the present invention will become more apparent to one skilled in the art from the following description and claims when read in light of the accompanying drawings.

BRIEF DESCRIPTION OF THE DRAWINGS

The present invention will be better understood by reading the Detailed Description of the Preferred and Selected Alternate Embodiments with reference to the accompanying drawing figures, in which like reference numerals denote similar structure and refer to like elements throughout, and in which.

DETAILED DESCRIPTION OF THE PREFERRED AND SELECTED ALTERNATIVE EMBODIMENTS

Figure 1A:
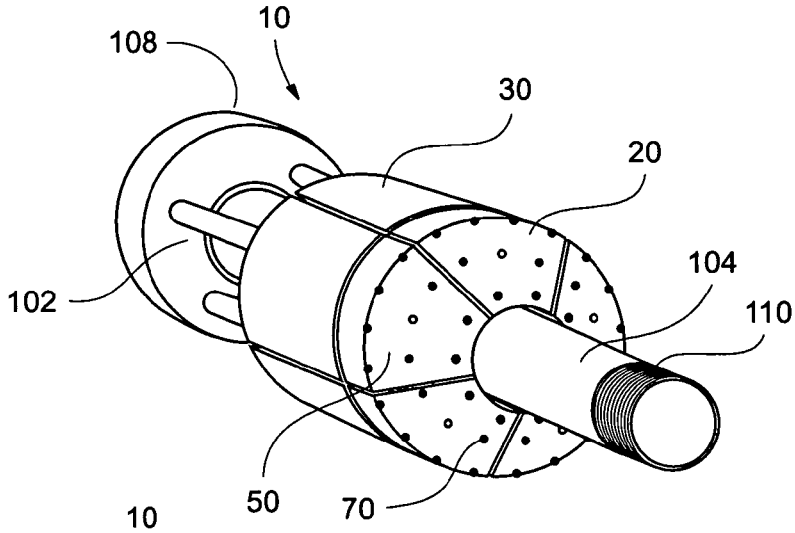
FIG. 1A is a perspective view of a percussive drill bit according to a preferred embodiment of the present invention.
Figure 1B:
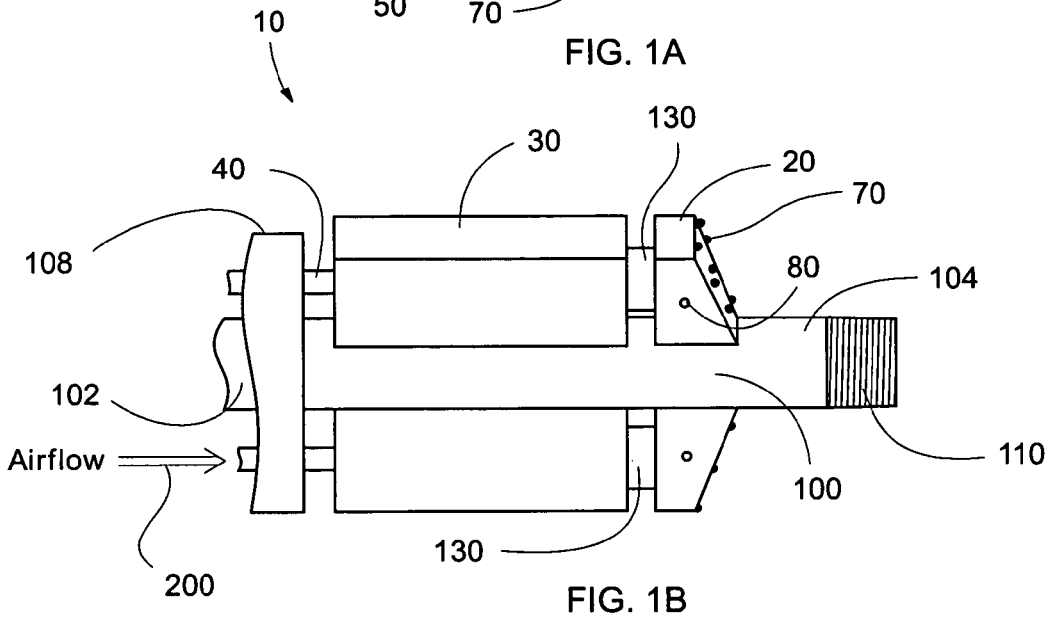
FIG. 1B is a side cutaway view of a percussive drill bit according to a preferred embodiment of the present invention.
Figure 2:
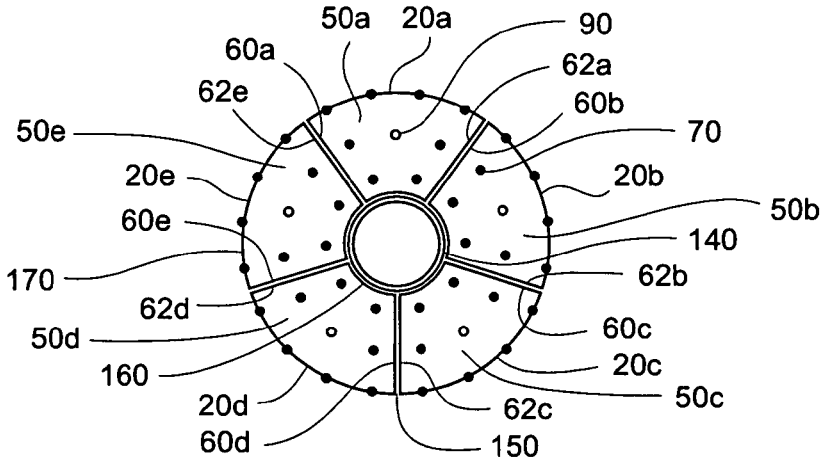
FIG. 2 is a front view of the cutting surface of a percussive drill bit according to a preferred embodiment of the present invention.
Figure 3A:
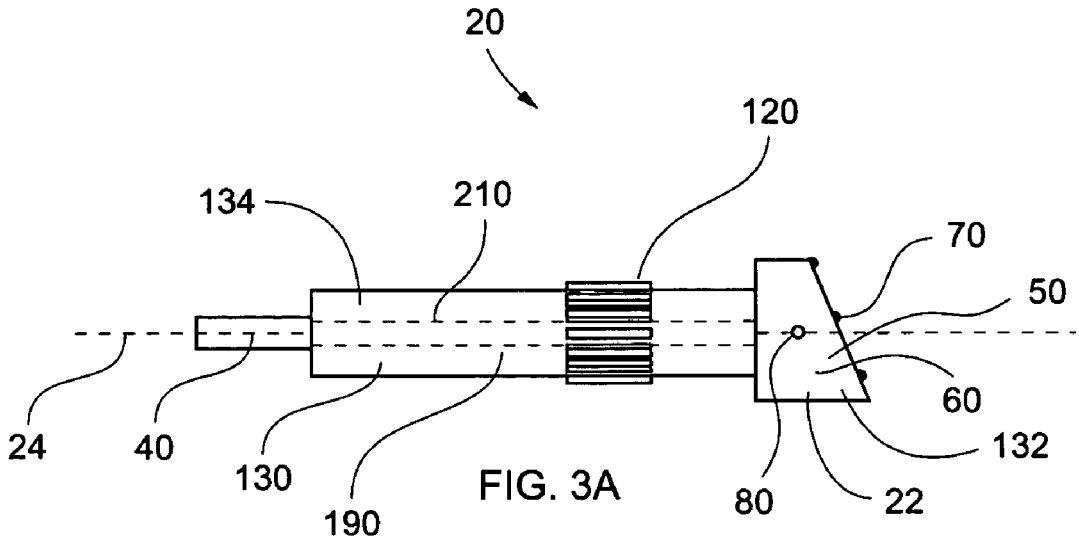
FIG. 3A is a side view of a percussive drill bit segment according to a preferred embodiment of the present invention.
Figure 3B:
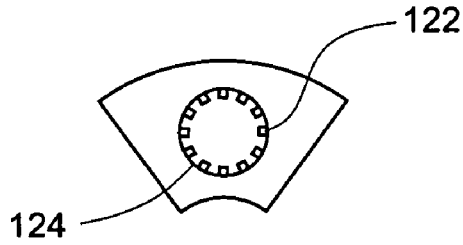
FIG. 3B is a front view of a percussive drill bit segment holder according to a preferred embodiment of the present invention.
Figure 3C:
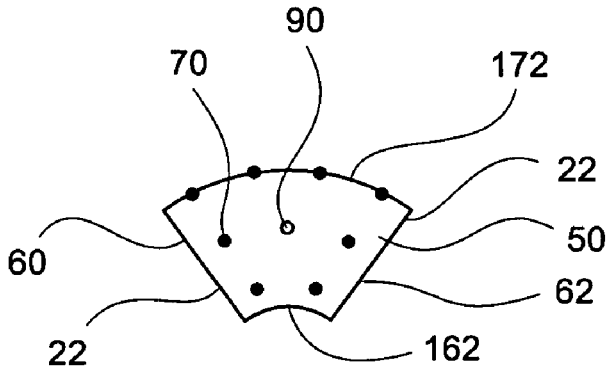
FIG. 3C is a front view of a percussive drill bit segment according to a preferred embodiment of the present invention.

In describing the preferred and selected alternate embodiments of the present invention, as illustrated in FIGS. 1A–3C, specific terminology is employed for the sake of clarity. The invention, however, is not intended to be limited to the specific terminology so selected, and it is to be understood that each specific element includes all technical equivalents that operate in a similar manner to accomplish similar functions.

Referring now to FIGS. 1A–3C, the present invention in a preferred embodiment comprises percussive drill bit apparatus 10, having a plurality of segments 20 and a plurality of segment holders 30, wherein individual bit segments 20 are held within segment holders 30. Segment holders 30 are disposed on and surround drill rod 100. Drill rod 100 has first end 102 and second end 104, wherein first end 102 is adapted to fit drill bit powering mechanism 108, and wherein second end 104 comprises threaded connector 110.

Segment holders 30 are preferably disposed circumferentially about drill rod 100 and are fixably attached thereto. Segment holders 30 retain bit segments 20, wherein bit segments 20 are parallel to one another and substantially parallel to drill rod 100.

Individual bit segment 20 preferably has first end 132, middle section 190 and second end 134. Air inlet 40 extends from second end 134, wherein air inlet 40 is adapted to receive exhaust air from powering mechanism 108 of drill bit apparatus 10, and wherein powering mechanism 108 receives air 200 from a high pressure air supply source.

Preferably disposed on middle section 190 of bit segment 20 are guides 120, wherein guides 120 slidably engage vanes 122 carried by inner circumference 124 of segment holder 30, thereby allowing bit segment 20 to move along axis 24 when driven by powering mechanism 108.

First end 132 of bit segment 20 preferably comprises bit head 22, wherein bit head 22 has face 50 and sides 60 and 62. Face 50 has face air hole 90 extending therethrough and cutting means 70 thereon, wherein cutting means 70 preferably comprises carbide buttons. It will be recognized by those skilled in the art that other cutting means could be substituted for carbide buttons without departing from the present invention. Segment body 130 has air channel 210 therewithin. Air 200 exiting from face air hole 90 blows debris accumulated by cutting action of cutting means 70 away from the rock face being worked. Sides 60 and 62 have side air hole 80 extending therethrough, wherein air 200 flows into air inlet 40 to channel 210. Air 200 flows via channel 210 to side air holes 80 and face air hole 90, exiting from side air hole 80 into gaps 150 (best shown in FIG. 2), thereby clearing gaps 150 of debris.

Five bit segments 20*a*, 20*b*, 20*c*, 20*d* and 20*e* form a donut shape, wherein bit segments 20*a*, 20*b*, 20*c*, 20*d* and 20*e* comprise first bit sides 60*a*, 60*b*, 60*c*, 60*d*, and 60*e*, respectively. Bit segments 20*a*, 20*b*, 20*c*, 20*d* and 20*e* further comprise second bit sides 62*a*, 62*b*, 62*c*, 62*d* and 62*e*, respectively, and faces 50*a*, 50*b*, 50*c*, 50*d* and 50*e*, respectively.

Faces 50*a*, 50*b*, 50*c*, 50*d* and 50*e*, are preferably slanted such that the flow of debris will be carried outwardly from central drill rod 100. It will be recognized by those in the art that faces 50*a*, 50*b*, 50*c*, 50*d* and 50*e*, could slant in any desired direction to facilitate cutting operations.

First bit segment 20*a* is positioned with first bit side 60*a* proximate second bit side 62*e* of second bit segment 20*e*, thereby forming small gap 150 between first bit side 60*a* and second bit side 62*e*.

Second bit segment 20*b* is positioned with first bit side 60*b* proximate second bit side 62*a* of second bit segment 20*a*, thereby forming small gap 150 between first bit side 60*b* and second bit side 62*a*.

Third bit segment 20*c* is positioned with first bit side 60*c* proximate second bit side 62*b* of second bit segment 20*b* thereby forming small gap 150 between first bit side 60*c* and second bit side 62*b*.

First bit segment 20*d* is positioned with first bit side 60*d* proximate second bit side 62*c* of second bit segment 20*c*, thereby forming small gap 150 between first bit side 60*d* and second bit side 62*c*.

First bit segment 20*e* is positioned with first bit side 60*e* proximate second bit side 62*d* of second bit segment 20*d*, thereby forming small gap 150 between first bit side 60*e* and second bit side 62*d*.

Bit segments 20*a*, 20*b*, 20*c*, 20*d* and 20*e* further comprise inner arc 162 and outer arc 172, wherein subsequent to placement of bit segments 20*a*, 20*b*, 20*c*, 20*d* and 20*e* adjacent one another, inner arcs 162 form inner circle 160, and outer arcs 172 form outer circle 170, thus forming the donut-shape of drill bit 10.

In operation, a pilot hole is drilled through a selected ground using a drill head and a drill rod string, whereupon, following the drilling operation, the drill rod string is left in place. The drill rod string is subsequently secured to apparatus 10 via threaded connector 110. As apparatus 10 is pulled against a rock face, bit segments 20 are driven by percussion power mechanism 108, repetitively impacting on the rock face, thereby pulverizing the rock face. Air 200 is fed into bit segments 20 as air 200 exhausts from percussion power mechanism 108, thus clearing debris from gap 150 via side air holes 80 and from the rock face via face air holes 90.

In an alternate embodiment of the present invention, it is envisioned that drill bit 10 could be utilized to drill a pilot hole by pushing drill bit 10 through virgin ground.

It is envisioned in an alternate embodiment of the present invention that drill bit 10 could have any number of bit segments.

It is envisioned that drill bit 10 could be connected to a steerable drilling mechanism comprising a bent drill subsection and a SONDE unit for tracking its location.

It is also contemplated in an alternate embodiment of the present invention that bit segment faces 50*a*, 50*b*, 50*c*, 50*d* and 50*e* could comprise any suitable shape.

The foregoing description and drawings comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing descriptions and the associated drawings. Although specific terms may be employed herein, they are used in a generic and descriptive sense only and not for purposes of limitation. Accordingly, the present invention is not limited to the specific embodiments illustrated herein, but is limited only by the following claims.

What is claimed is:

1. A percussive pull reamer comprising:

a central rod;

at least two bit segments carried by said central rod, each bit segment having a face and sides, wherein said at least two bit segments comprise a body and a head, wherein said head carries said face and said sides, and wherein at least one of said sides includes at least one side hole for exit of a fluid therefrom; and a gap between said sides of said at least two bit segments.

2. The percussive pull reamer of claim 1, wherein said fluid is air.

3. The percussive pull reamer of claim 1, wherein said face further comprises means for cutting.

4. The percussive pull reamer of claim 3, wherein said means for cutting comprises carbide buttons.

5. A percussive pull reamer comprising:

a central rod;

at least two bit segments carried by said central rod, each bit segment having a face and sides; and a gap between said sides of said at least two bit segments, wherein said at least two bit segments form a ring.

6. A percussive pull reamer comprising:

a central rod;

at least two bit segments carried by said central rod, each bit segment having a face and sides;

a gap between said sides of said at least two bit segments; and a means for powering said percussive pull reamer, wherein said means for powering comprises a drill head assembly having a pressurized air supply.

7. A percussive pull reamer comprising:

a central rod;

at least two bit segments carried by said central rod, each bit segment having a face and sides; and a gap between said sides of said at least two bit segments, wherein said face is adapted to permit flow of debris outwardly away from said central rod.

8. A percussive pull reamer comprising:

a central rod;

at least two bit segments carried by said central rod, each bit segment having a face and sides; and a gap between said sides of said at least two bit segments, wherein said face comprises at least one air hole.

9. A method of forming a bore hole comprising the steps of:

a. obtaining a reamer, wherein said reamer comprises at least two bit segments, each bit segment having a face and sides, and further comprising at least one gap, wherein said at least one gap lies between said at least two bit segments; and b. pushing said reamer through a hole, whereby the hole is enlarged.

10. A method of forming a bore hole comprising the steps of:

a. obtaining a reamer, wherein said reamer comprises at least two bit segments, each bit segment having a face and sides, said reamer further comprising at least one gap, wherein said at least one gap lies between said at least two bit segments, wherein said reamer further comprises a central rod and said at least two bit segments carried by said central rod, and wherein said at least two bit segments comprise a body and a head, and wherein said head carries said face and said sides, and wherein at least one of said sides includes at least one side hole for exit of a fluid therefrom; and b. pulling said reamer through a hole, whereby the hole is enlarged.

11. The method of claim 10, wherein said face is adapted to permit flow of debris outwardly away from said central rod.

12. The method of claim 10, wherein said fluid is air.

13. A method of forming a bore hole comprising the steps of:

a. obtaining a reamer, wherein said reamer comprises at least two bit segments, each bit segment having a face and sides, said reamer further comprising at least one gap, wherein said at least one gap lies between said at least two bit segments, and wherein said reamer is adapted to percussive operation; and b. pulling said reamer through a hole, whereby the hole is enlarged.

14. A method of forming a bore hole comprising the steps of:

a. obtaining a reamer, wherein said reamer comprises at least two bit segments, and wherein said at least two bit segments form a ring, each bit segment having a face and sides, said reamer further comprising at least one gap, wherein said at least one gap lies between said at least two bit segments; and b. pulling said reamer through a hole, whereby the hole is enlarged.

15. A method of forming a bore hole comprising the steps of:

a. obtaining a reamer, wherein said reamer comprises at least two bit segments, each bit segment having a face and sides, said reamer further comprising at least one gap, wherein said at least one gap lies between said at least two bit segments, and wherein said face further comprises at least one air hole and a means for cutting; and b. pulling said reamer through a hole, whereby the hole is enlarged.

* * * * *